US011802711B2

(12) United States Patent
Sato et al.

(10) Patent No.: US 11,802,711 B2
(45) Date of Patent: Oct. 31, 2023

(54) INFORMATION PROCESSING DEVICE AND AIR CONDITIONING SYSTEM

(71) Applicant: Mitsubishi Electric Corporation, Tokyo (JP)

(72) Inventors: Yasushi Sato, Tokyo (JP); Takanori Kyoya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/910,071

(22) PCT Filed: Apr. 28, 2020

(86) PCT No.: PCT/JP2020/018086
§ 371 (c)(1),
(2) Date: Sep. 8, 2022

(87) PCT Pub. No.: WO2021/220391
PCT Pub. Date: Nov. 4, 2021

(65) Prior Publication Data

US 2023/0108991 A1 Apr. 6, 2023

(51) Int. Cl.
*F24F 11/64* (2018.01)
*F24F 11/56* (2018.01)
(Continued)

(52) U.S. Cl.
CPC ..... *F24F 11/64* (2018.01); *F24F 11/56* (2018.01); *F24F 2120/12* (2018.01); *F24F 2120/20* (2018.01)

(58) Field of Classification Search
CPC ..... F24F 11/62; F24F 11/64; F24F 2110/10; F24F 2120/20; F24F 11/30;
(Continued)

(56) References Cited

U.S. PATENT DOCUMENTS 5,170,935 A * 12/1992 Federspiel ..... F24F 11/63 236/94
7,216,021 B2 * 5/2007 Matsubara ..... H02J 3/00 700/277
(Continued)

FOREIGN PATENT DOCUMENTS

EP 2 060 857 A1 5/2009
EP 3 657 088 A1 5/2020
(Continued)

OTHER PUBLICATIONS

Yuzhen Peng, Zoltán Nagy, Arno Schlüter, Temperature-preference learning with neural networks for occupant-centric building indoor climate controls, Building and Environment, vol. 154, 2019, pp. 296-308, ISSN 0360-1323 (Year: 2019).*
(Continued)

*Primary Examiner* — Darrin D Dunn
(74) *Attorney, Agent, or Firm* — POSZ LAW GROUP, PLC

(57) ABSTRACT

Each of plurality of personal terminals is configured to acquire first data indicating a result of inputting whether a possessor is comfortable, second data indicating a terminal location, and third data indicating a temperature at the terminal location. An information processing device includes a first learning unit to classify the plurality of personal terminals into a plurality of classes based on the first to third data transmitted from the plurality of personal terminals, a storage unit to store a plurality of control details each associated with a corresponding one of the plurality of classes into which the first learning unit classifies the plurality of personal terminals, and a control unit to read, from the storage unit, a control detail associated with a class into which a personal terminal detected in an air condition-
(Continued)

ing target space is classified among the plurality of classes and control an air conditioning device.

8 Claims, 6 Drawing Sheets

(51) Int. Cl.
*F24F 120/20* (2018.01)
*F24F 120/12* (2018.01)

(58) Field of Classification Search
CPC .... F24F 2120/00; F24F 2120/10; F24F 11/54; F24F 11/65; F24F 2120/12; G06N 20/00; G06N 3/08; G06N 3/045; G05B 2219/2614; G05B 15/02; G05B 2219/2642; G05B 13/027; G06F 3/04847
See application file for complete search history.

(56) References Cited

U.S. PATENT DOCUMENTS

| | | | | |
|---|---|---|---|---|
| 10,583,709 | B2 * | 3/2020 | Chen | B60N 2/919 |
| 11,155,140 | B2 * | 10/2021 | Chen | B60N 2/976 |
| 11,359,969 | B2 * | 6/2022 | Shayne | H04N 5/33 |
| 11,675,322 | B2 * | 6/2023 | Du | G06N 3/08 700/278 |
| 2010/0036533 | A1 | 2/2010 | Masuda et al. | |
| 2015/0330645 | A1 | 11/2015 | Speranzon et al. | |
| 2016/0161137 | A1 | 6/2016 | Chen et al. | |
| 2016/0320081 | A1 * | 11/2016 | Nikovski | G06F 16/2228 |
| 2019/0103182 | A1 * | 4/2019 | Borshch | G06F 16/24575 |
| 2019/0283531 | A1 * | 9/2019 | Spryshak | B60H 1/0075 |
| 2020/0134891 | A1 | 4/2020 | Ohta et al. | |
| 2021/0140660 | A1 * | 5/2021 | Kogo | G06F 30/20 |
| 2021/0217532 | A1 * | 7/2021 | Heimerl | A61B 5/026 |
| 2021/0285671 | A1 * | 9/2021 | Du | F24F 11/65 |
| 2021/0287311 | A1 * | 9/2021 | Bentz | G06F 3/04883 |

FOREIGN PATENT DOCUMENTS

| | | | |
|---|---|---|---|
| JP | 2011-075138 | A | 4/2011 |
| JP | 2011-208936 | A | 10/2011 |
| JP | 6114807 | B | 4/2017 |
| JP | 2019-027603 | A | 2/2019 |
| JP | 2019-124414 | A | 7/2019 |
| WO | 2008/087959 | A1 | 7/2008 |
| WO | 2018/163272 | A1 | 9/2018 |
| WO | 2019/013014 | A1 | 1/2019 |

OTHER PUBLICATIONS

Gupta et al., Santosh K. Gupta, Sam Atkinson, Ian O'Boyle, John Drogo, Koushik Kar, Sandipan Mishra, John T. Wen, BEES: Real-time occupant feedback and environmental learning framework for collaborative thermal management in multi-zone, multi-occupant buildings, Energy and Buildings. (Year: 2016).*

International Search Report of the International Searching Authority dated Jul. 28, 2020 for the corresponding International application No. PCT/JP2020/018086 (and English translation).

Office Action dated Jun. 13, 2023 in counterpart Japanese Patent Application No. 2022-518478 (and English translation).

* cited by examiner

INFORMATION PROCESSING DEVICE AND AIR CONDITIONING SYSTEM

CROSS REFERENCE TO RELATED APPLICATION

This application is a U.S. national stage application of International Patent Application No. PCT/JP2020/018086 filed on Apr. 28, 2020, the disclosure of which is incorporated herein by reference.

TECHNICAL FIELD

The present disclosure relates to an information processing device and an air conditioning system.

BACKGROUND

Japanese Patent No. 6114807 discloses a controlling system for environmental comfort and controlling method of the controlling system, the controlling system being capable of automatically adjusting comfort of an indoor environment by automatically controlling indoor apparatuses when a person is detected indoor.

PATENT LITERATURE

PTL 1: Japanese Patent No. 6114807

The controlling system for environmental comfort disclosed in Japanese Patent No. 6114807, however, does not take into account the presence of a plurality of users, and thus does not automatically adjust comfort to suit a plurality of different users. Further, comfort cannot be guaranteed when a plurality of users are present in the same room.

Further, only environment parameters are taken into account, so that comfort may be significantly reduced immediately after a person moves from the outside, for example.

An information processing device and an air conditioning system according to the present disclosure are provided to solve the above-described problems and achieve air conditioning control suitable even for a situation where there are a plurality of users such as an office.

SUMMARY

The present disclosure relates to an information processing device to communicate with a plurality of personal terminals possessed by a plurality of different possessors. Each of the plurality of personal terminals is configured to acquire first data indicating a result of inputting whether a corresponding one of the possessors is comfortable, second data indicating a terminal location, and third data indicating a temperature at the terminal location. The information processing device includes a first learning unit to classify the plurality of personal terminals into a plurality of classes based on the first to third data transmitted from the plurality of personal terminals, a storage unit to store a plurality of control details each associated with a corresponding one of the plurality of classes into which the first learning unit classifies the plurality of personal terminals, and a control unit to read, from the storage unit, a control detail associated with a class into which a personal terminal detected in an air conditioning target space is classified among the plurality of classes and control an air conditioning device.

The information processing device and the air conditioning system according to the present disclosure perform, even when a plurality of users are present, air conditioning control to set a temperature of the air conditioning target space appropriate for the users.

DETAILED DESCRIPTION

Figure 1:
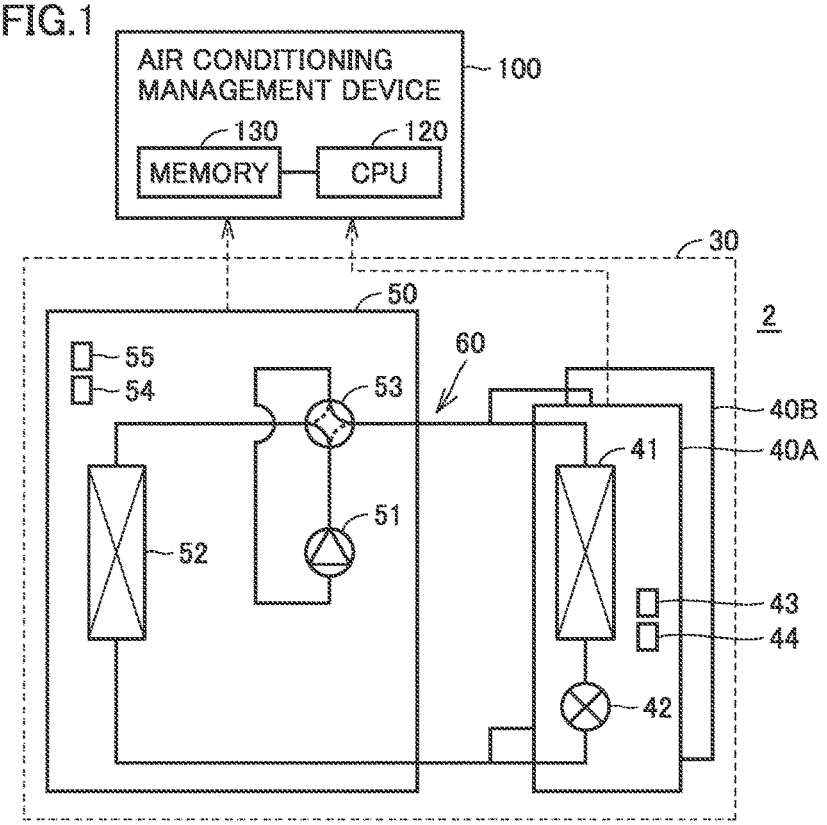
FIG. 1 is a diagram illustrating a schematic configuration of an air conditioning system according to a present embodiment.

Embodiments of the present invention will be described in detail with reference to the drawings. Note that the same or corresponding parts in the drawings are denoted by the same reference numerals to avoid the description from being redundant. Note that, in the following drawings, a relation among the sizes of the components may be different from an actual relation.

First Embodiment

FIG. 1 is a diagram illustrating a schematic configuration of an air conditioning system according to the present embodiment.

An air conditioning system 2 includes an air conditioning device 30 and an air conditioning management device 100. Air conditioning device 30 includes an outdoor unit 50 and indoor units 40A, 40B.

Outdoor unit 50 includes a compressor 51 that compresses and discharges a refrigerant, a heat source-side heat exchanger 52 that exchanges heat between outside air and the refrigerant, and a four-way valve 53 that changes a circulation direction of the refrigerant in accordance with an operation mode. Outdoor unit 50 includes an outside-air temperature sensor 54 that detects an outside-air temperature and an outside-air humidity sensor 55 that detects an outside-air humidity.

Indoor unit 40A and indoor unit 40B are connected in parallel to outdoor unit 50 in a refrigerant circuit.

Indoor unit 40A includes a load-side heat exchanger 41 that exchanges heat between indoor air and the refrigerant, an expansion device 42 that decompresses the highly pressurized refrigerant to expand the refrigerant, an indoor temperature sensor 43 that detects an indoor temperature, and an indoor humidity sensor 44 that detects an indoor humidity. Indoor unit 40B is the same in configuration as indoor unit 40A, so that neither illustration nor description of the internal configuration will be given below.

Compressor 51 is, for example, an inverter compressor having a capacity variable in accordance with a change in operating frequency. Expansion device 42 is, for example, an electronic expansion valve.

In outdoor unit 50 and indoor units 40A, 40B, compressor 51, heat source-side heat exchanger 52, expansion device 42, and load-side heat exchanger 41 are connected to constitute a refrigerant circuit 60 through which the refrigerant circulates. Accordingly, in a space having a plurality of indoor units provided, even when an indoor unit other than the nearest indoor unit is put into operation, the temperature and humidity in the space will change. Therefore, according to the present embodiment, for air conditioning of a space having a plurality of indoor units provided, reinforcement learning of control of a plurality of air conditioners is performed to explore an optimal value.

Air conditioning management device 100 includes a CPU 120, a memory 130, a temperature sensor (not illustrated), an input device, and a communication device. Air conditioning management device 100 transmits a control signal from the communication device to each of indoor units 40A, 40B.

Memory 130 includes, for example, a read only memory (ROM), a random access memory (RAM), and a flash memory. Note that the flash memory stores an operating system, an application program, and various types of data.

CPU 120 controls the overall operation of air conditioning device 30. Note that air conditioning management device 100 illustrated in FIG. 1 is implemented by the operating system and the application program executed by CPU 120, the operating system and the application program being stored in memory 130. Note that, during the execution of the application program, the various types of data stored in memory 130 are accessed. A receiver that receives the control signal from the communication device of air conditioning management device 100 is provided in each of indoor units 40A, 40B.

Figure 2:
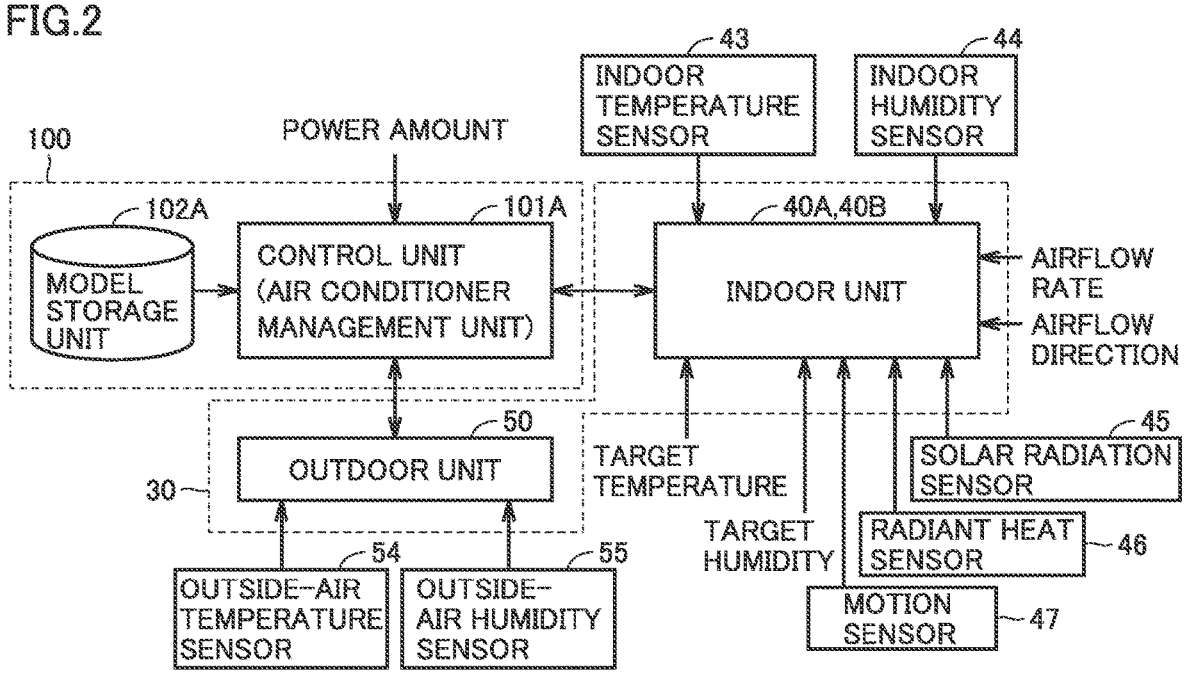
FIG. 2 is a functional block diagram of an air conditioning management device 100.

FIG. 2 is a functional block diagram of air conditioning management device 100. Air conditioning management device 100 includes a control unit 101A and a model storage unit 102A. CPU 120 illustrated in FIG. 1 operates as control unit 101A, and memory 130 operates as model storage unit 102A.

Control unit 101A controls indoor units 40A, 40B and outdoor unit 50 on the basis of outputs of various sensors and setting information. Control unit 101A receives, from indoor units 40A, 40B, a temperature detected by indoor temperature sensor 43, a humidity detected by indoor humidity sensor 44, a solar radiation amount detected by a solar radiation sensor 45, thermal information detected by a radiant heat sensor 46, and a detection signal of a motion sensor 47 as the outputs of the various sensors. Control unit 101A further receives, from outdoor unit 50, a temperature detected by outside-air temperature sensor 54 and a humidity detected by outside-air humidity sensor 55 as the outputs of the various sensors.

Control unit 101A further receives, as the setting information, various types of information including a target temperature, a target humidity, an airflow rate, and an airflow direction set for indoor units 40A, 40B.

Control unit 101A changes a flow path of four-way valve 53 in accordance with the operation mode of air conditioning device 30, either a cooling operation mode or a heating operation mode.

Control unit 101A controls additional learning for a learned model stored in model storage unit 102A. Control unit 101A controls air conditioning system 2 using the learned model stored in model storage unit 102A in the inference phase.

Air conditioning management device 100 manages air conditioning device 30 to enable automatic control of air conditioning device 30 using action information on a person.

Figure 3:
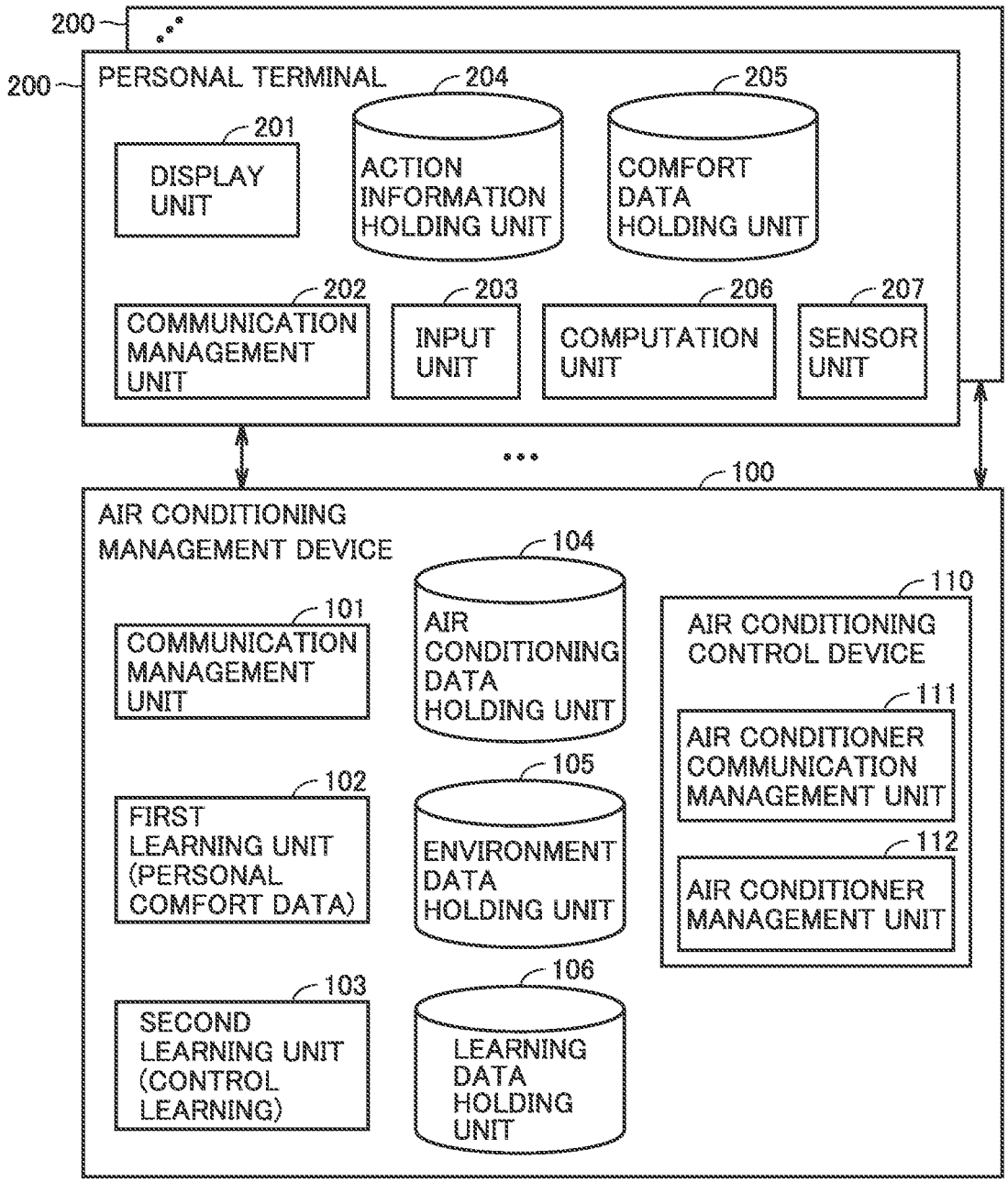
FIG. 3 is a block diagram illustrating blocks of a personal terminal and the air conditioning management device linked with the personal terminal.

FIG. 3 is a block diagram illustrating blocks of a personal terminal and the air conditioning management device linked with the personal terminal.

As illustrated in FIG. 3, air conditioning management device 100 includes a communication management unit 101, a personal comfort data learning unit 102, a control learning unit 103, an air conditioning data holding unit 104, an environment data holding unit 105, a learning data holding unit 106, and an air conditioning control device 110. Air conditioning control device 110 includes an air conditioner communication management unit 111 and an air conditioner management unit 112.

Air conditioning management device 100 is connected to a personal terminal 200 by radio. Communication management unit 101 manages communications with personal terminal 200.

Personal comfort data learning unit 102 groups individuals who possess personal terminals 200 on the basis of information held by personal terminals 200. Personal comfort data learning unit 102 groups the possessors of personal terminals 200 using unsupervised learning of comfort data of each individual held by comfort data holding unit 205 of a corresponding personal terminal 200.

Control learning unit 103 uses data in air conditioning data holding unit 104, environment data holding unit 105, and learning data holding unit 106 to learn and infer control optimal for each condition using reinforcement learning.

From the above-described data, the control learning unit determines to perform control so as to maximize energy saving while maintaining the comfort of a person present in an air conditioning area as much as possible.

Air conditioning data holding unit 104 holds control data (target temperature, target humidity, airflow rate, airflow direction, etc.) of air conditioning device 30 used for learning.

Environment data holding unit 105 holds, in time series, an outside-air temperature, and a temperature, a humidity, a solar radiation amount, and an object surface temperature (radiant heat) in each air conditioning area.

When the plurality of indoor units 40A, 40B are provided, motion sensor 47 is provided for each indoor unit. A range that motion sensor 47 can cover is the air conditioning area of the air conditioner. Air conditioning system 2 can change a temperature set for each air conditioning area. Movement of a person in the area can be detected by motion sensor 47 connected to each of indoor units 40A, 40B.

Learning data holding unit 106 holds data to be used by control learning unit 103 and personal comfort data learning unit 102. Specifically, learning data holding unit 106 holds a degree of dissatisfaction necessary for evaluation of learning and power consumption of air conditioning device 30.

Air conditioner communication management unit 111 of air conditioning control device 110 manages communications with air conditioning device 30. Air conditioner management unit 112 manages control of air conditioning device 30.

Personal terminal 200 is a terminal possessed by each individual. Personal terminal 200 includes a display unit 201, a communication management unit 202, an input unit 203, an action information holding unit 204, a comfort data holding unit 205, a computation unit 206, and a sensor unit 207. Communication management unit 202 manages communications with air conditioning management device 100.

Sensor unit 207 is capable of detecting a location and movement distance of personal terminal 200, and a temperature and humidity in the vicinity of personal terminal 200. For example, sensor unit 207 includes an acceleration sensor, a GPS, a temperature sensor, and a humidity sensor. Computation unit 206 can compute the movement distance by integrating acceleration detected by the acceleration sensor and combining the integration result with location information detected by the GPS. It is thought that the smaller a temperature change, the smaller the influence on comfort. Therefore, in the present embodiment, movement of a person from the outside of the air conditioning area (outside of a room) to the air conditioning area that causes a large temperature change is mainly detected.

Action information holding unit 204 holds a movement path of an individual carrying personal terminal 200. The movement path includes a movement distance, a movement time, a movement speed, and the like.

Comfort data holding unit 205 holds, in time series, comfort data such as hot or cold input by an individual and location information at the time of the input.

Note that action information holding unit 204 and comfort data holding unit 205 may be associated with each other in time series.

In FIG. 3, personal comfort data learning unit 102 is provided in air conditioning management device 100, but personal comfort data learning unit 102 may be provided in personal terminal 200, so that computational resources required for air conditioning management device 100 can be reduced.

Further, not all the data detected by sensor unit 207 but some of the data may be used for learning. This allows a reduction in the computational resources.

Further, in FIG. 3, communication management unit 101 is described as if to directly communicate with personal terminal 200, but communication management unit 101 may communicate with personal terminal 200 via a cloud or a relay device.

Figure 4:
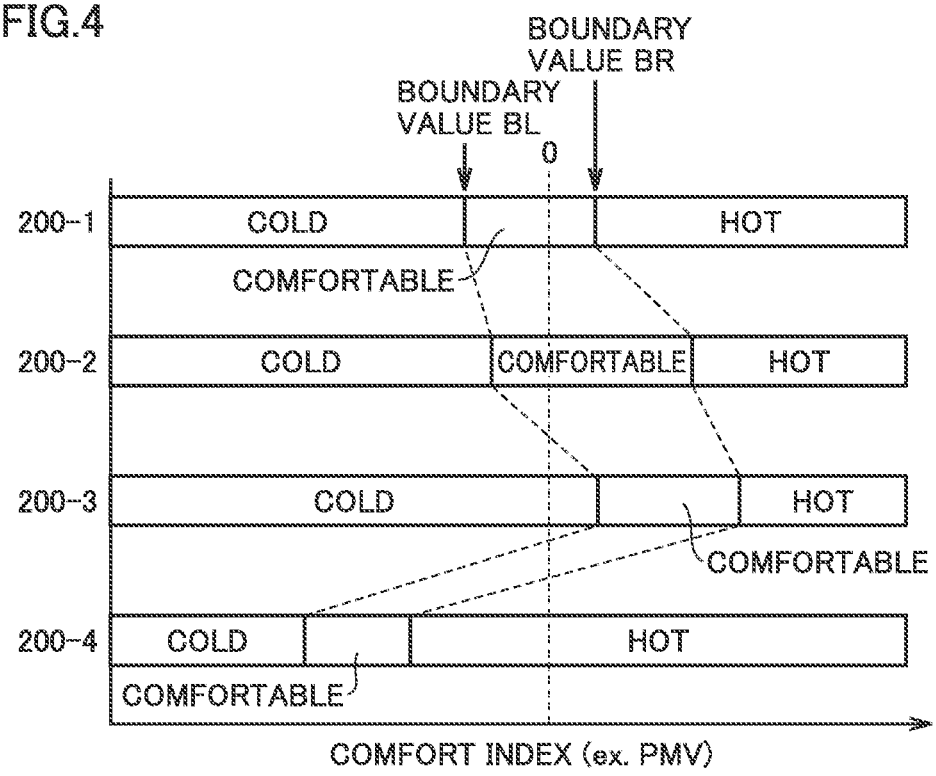
FIG. 4 is a diagram illustrating an example of individual comfort data used for learning held by a comfort data holding unit 205.

FIG. 4 is a diagram illustrating an example of individual comfort data used for learning held by comfort data holding unit 205. Reference numerals 200-1 to 200-4 in FIG. 4 denote codes for identifying the personal terminals. Comfort data holding unit 205 holds a range of a comfort index in which an individual feels comfortable (for example, predicted mean vote (PMV) that is a thermal environment evaluation index). Computation unit 206 computes the comfort index such as PMV from an indoor temperature, an indoor humidity, an airflow rate, and the like when sensory data such as "hot" or "cold" is input from input unit 203 of the personal terminal, and accumulates the comfort index thus computed into comfort data holding unit 205 as data. Computation unit 206 computes boundary values BL, BR of "cold", "comfortable", and "hot" from such pieces of data, and stores boundary values BL, BR into comfort data holding unit 205.

Figure 5:
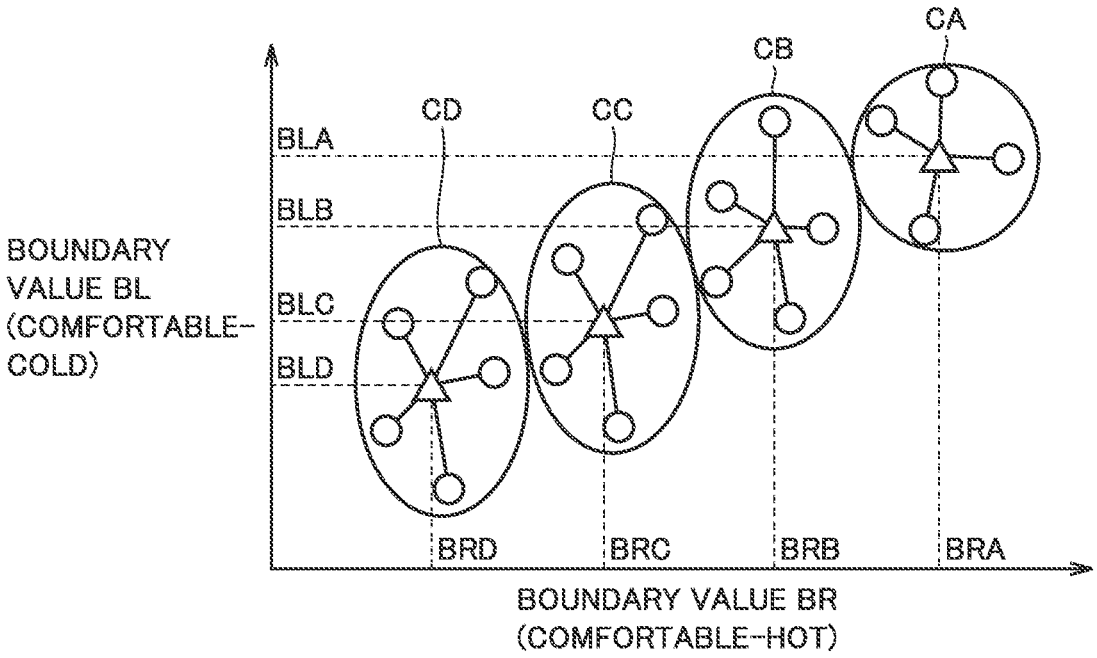
FIG. 5 is a diagram illustrating an example of a machine learning model used by a personal comfort data learning unit 102.

FIG. 5 is a diagram illustrating an example of a machine learning model used by personal comfort data learning unit 102. As data input to the machine learning model illustrated in FIG. 5, the individual comfort data illustrated in FIG. 4 is used.

Circles plotted in FIG. 5 are each associated with a corresponding one of the personal terminals denoted as 200-1 to 200-4 in FIG. 4. The vertical axis in FIG. 5 represents a position of a boundary between "comfortable" and "cold" in FIG. 4, and the horizontal axis in FIG. 5 represents a position of a boundary between "comfortable" and "hot" in FIG. 4. In FIG. 5, points each indicating individual comfort in FIG. 4 are plotted. Clustering, belonging to unsupervised learning, is applied to the set of plotted points to classify users on the basis of comfortableness.

That is, the input to the machine learning model illustrated in FIG. 5 includes boundary value BL between "cold" and "comfortable" and boundary value BR between "comfortable" and "cold" when the individual comfort index (for example, PMV) described with reference to FIG. 4 is used as an index. When such values are input, the output from the machine learning model is a classification result (CA to CD).

FIG. 5 illustrates an example in which k-means clustering is used. As a result of the clustering, the personal terminals are classified into four classes CA, CB, CC, CD. A triangle located approximately at a center of each class indicates a centroid of the set of points indicated by the personal terminal belonging to the class. The centroid is a point indicating a mean of ordinate values of the set of points of each class and a mean of abscissa values.

The machine learning model illustrated in FIG. 5 groups the input data under unsupervised learning.

Figure 6:
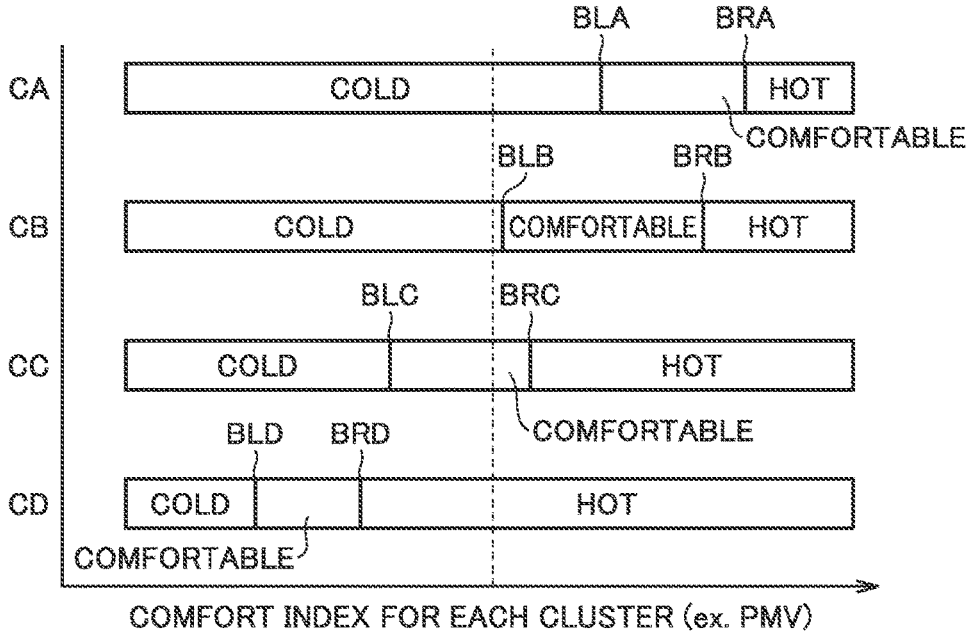
FIG. 6 is a diagram illustrating a comfort range of each class after classification.

FIG. 6 is a diagram illustrating a comfort range of each class after classification. The point (median value of comfort) indicated by the triangle, which is the centroid obtained by k-means clustering, is used to indicate the comfort of each class.

The result of the clustering obtained in FIGS. 4 to 6 is used for controlling the air conditioner as follows. When a plurality of people are present in an air conditioning target space and belong to a plurality of classes, control is performed on an area where the comfort ranges of the plurality of classes overlap. For example, when a person belonging to class CA and a person belonging to class CB in FIG. 6 are present, control is performed on an area between a boundary value BLA and a boundary value BRB as a comfort area.

Note that, when there is no overlapping comfort area such as between class CA and class CC, control is performed on an area where a distance to the comfort areas of the two classes is shortest, for example, an area between boundary value BLA and a boundary value BRC.

The policy of the above-described control is to enhance "comfort". Further, the other policy of the control is to enhance "energy saving".

In the present embodiment, specific values are learned to determine what kind of control is specifically performed in what state. Such learning is called reinforcement learning.

Positive control includes the enhancement of "comfort" for reducing user's dissatisfaction and the enhancement of "energy saving" for reducing power consumption.

When the control of the air conditioning for the air conditioning area cannot be applied to the comfort area of the user, for example, when a higher priority is given to the enhancement of "energy saving", recommendation control described in the second embodiment to be described later is performed.

Control learning unit 103 illustrated in FIG. 3 learns what kind of control should be performed in a certain state in order to reduce dissatisfaction and enhance energy saving to determine the control. Reinforcement learning is used as the determination method.

Figure 7:
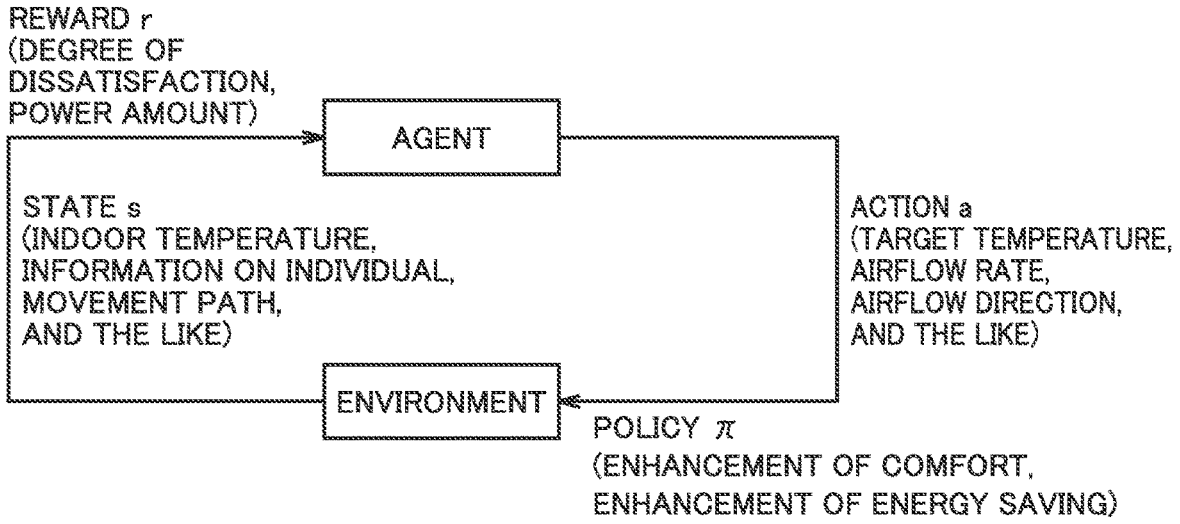
FIG. 7 is a diagram illustrating a structure of machine learning used by a control learning unit 103 according to a first embodiment.

FIG. 7 is a diagram illustrating a structure of machine learning used by control learning unit 103 according to the first embodiment. Under reinforcement learning, an agent (action subject) in a certain environment observes a current state s (environment parameter) to determine an action a to be taken. The action taken by the agent causes the environment to dynamically change, and a reward r is given to the agent in accordance with the change in the environment. The agent repeats this process to learn an action policy under which reward r is maximized through a series of actions a. As representative algorithms of reinforcement learning, Q-learning and TD-learning are known.

Input and output parameters of reinforcement learning are as follows:

- state s: indoor temperature, indoor humidity, outside-air temperature, information on an individual in air conditioning area, solar radiation amount, radiant heat, and movement path (movement time, movement distance, and movement speed).
- action a: change in target temperature, change in target humidity, and change in setting of airflow rate and airflow direction.
- reward r: degree of dissatisfaction, and power amount.
- policy π: setting of two patterns of enhancement of comfort and enhancement of energy saving.

Control learning unit 103 can select the enhancement of "energy saving" or the enhancement of "comfort" as policy π. As action a, four settings are listed above, which takes time for learning, so that the settings may be narrowed down to only the change in target temperature or only the change in target humidity. Further, other settings of the air conditioner such as the setting of vanes may be changed.

The enhancement of "comfort" as policy π is to perform control to bring the current state into a range in which an individual feels comfortable. The enhancement of "energy saving" is to perform control to reduce power consumption relative to the current state. For example, during the cooling period, the set temperature or the set humidity is increased, and during the heating period, the set temperature or the set humidity is decreased. Further, making the airflow rate lower also corresponds to the control for the enhancement of energy saving.

One of the features of the present embodiment is that comfort priority and energy saving priority are used as policy it of reinforcement learning illustrated in FIG. 7. Reinforcement learning is performed with the comfort priority and the energy saving priority selectable as policy it for each air conditioning area. This allows the control of the air conditioner to be changed to control suitable for each air conditioning area.

The input to the machine learning model illustrated in FIG. 7 includes information listed in state s described above. The reinforcement learning according to the present embodiment is learning in which action a (output) is taken with respect to state s, and action a is corrected in accordance with how the results such as the degree of individual dissatisfaction and the power amount have changed. How to correct action a correspond to policy π. Policy π can be selected from the two types, that is, the enhancement of energy saving (reduction in power amount) and the enhancement of comfort (reduction in degree of dissatisfaction), and learning is advanced.

Policy π may be either of the two types, but policy π need not necessarily be either of the two types and may be determined as a probability of each policy. For example, when the learning is performed with the probability of the enhancement of energy saving set at 30% and the probability of the enhancement of comfort set at 70%, it is possible to learn to enhance energy saving while maintaining comfort.

Figure 8:
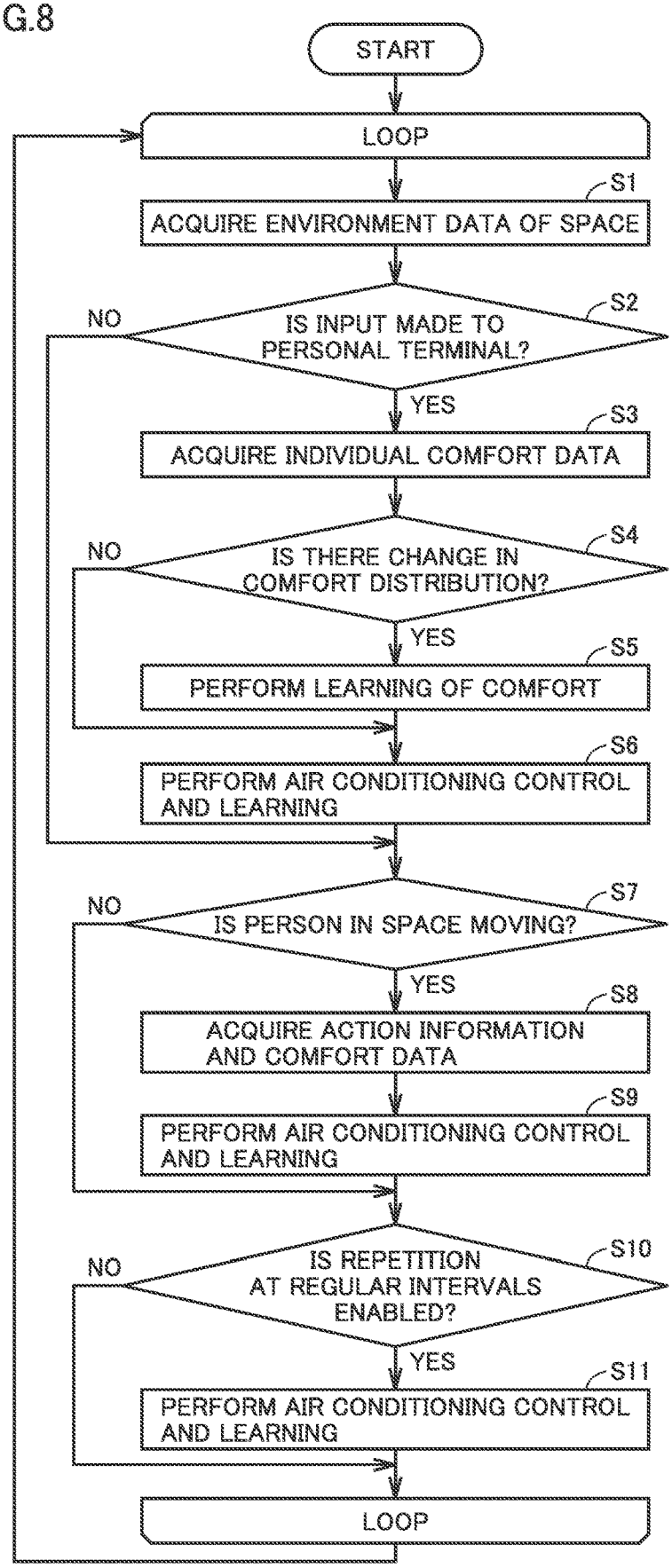
FIG. 8 is a flowchart for describing control to be performed according to the present embodiment.

FIG. 8 is a flowchart for describing control performed according to the present embodiment. The machine learning illustrated in FIG. 7 is performed in steps S6, S9, S11 in the flowchart of FIG. 8.

First, environment data of the air conditioning target space is periodically acquired. Specifically, in step S1, air conditioner management unit 112 acquires the indoor temperature, the indoor humidity, the outside-air temperature, the solar radiation amount, and the radiant heat from the various sensors of air conditioning device 30 (indoor units 40A, 40B and outdoor unit 50).

Subsequently, upon receipt input from the personal terminal, air conditioning control and learning are performed. The comfort data of the individual who has made the input is acquired, and when there is a change in the comfort data, learning of comfort is performed.

Specifically, when input is made to input unit 203 of personal terminal 200 in step S2, the input information is notified to air conditioning management device 100 via communication management unit 202. With this notification as a trigger, air conditioning management device 100 makes the determination in step S2.

When input is made to personal terminal 200 (YES in S2), air conditioning management device 100 acquires the information held in comfort data holding unit 205 of personal terminal 200 via communication management unit 101 in step S3.

In step S4, individual comfort data in FIG. 2 is taken from the comfort data thus acquired, and when the boundary value between "cold" and "comfort" and the boundary value between "comfort" and "hot" have changed, it is determined that there is a change in comfort distribution (YES in S4).

In step S5, learning of classification is performed using the machine learning model illustrated in FIG. 5. Subsequently, in step S6, reinforcement learning is performed using the machine learning model illustrated in FIG. 7.

Next, when a person moves within the air conditioning area, data of individuals in the area is acquired, and air conditioning control and learning are performed.

First, in step S7, air conditioner management unit 112 determines that a person has moved when a change in motion information is detected from the information from motion sensor 47 connected to air conditioning device 30.

In step S8, air conditioning management device 100 acquires the information held in action information holding unit 204 and the information held in comfort data holding unit 205 from personal terminal 200 via communication management unit 101.

Subsequently, in step S9, reinforcement learning is performed using the machine learning model illustrated in FIG. 7.

Air conditioning management device 100 further performs air conditioning control and learning at predetermined regular intervals to increase control accuracy.

Specifically, in order to perform control to enhance energy saving and comfort even when no person moves or no input is made from the personal terminal, it is determined whether the repetition at the regular intervals is enabled in step S10, and in step S11, and reinforcement learning is performed using the machine learning model illustrated in FIG. 7. The length of the regular intervals may be, for example, 10 minutes, but may be a different length.

In the first embodiment described above, it is possible to learn a change in comfort immediately after movement using action information on a person. Further, automatic control of air conditioning achieved by trial and error using reinforcement learning as illustrated in FIG. 7 makes it possible to maximize energy saving within a range in which the user feels comfortable.

Further, the number of operations made by the user gradually decreases as the learning progresses, so that it is possible to increase the usefulness of the air conditioner.

Further, in a place where the same team of users is present like an office and a plurality of indoor units are provided, it is possible to achieve air conditioning control optimal for a person present in the air conditioning area of each indoor unit.

Second Embodiment

Figure 9:
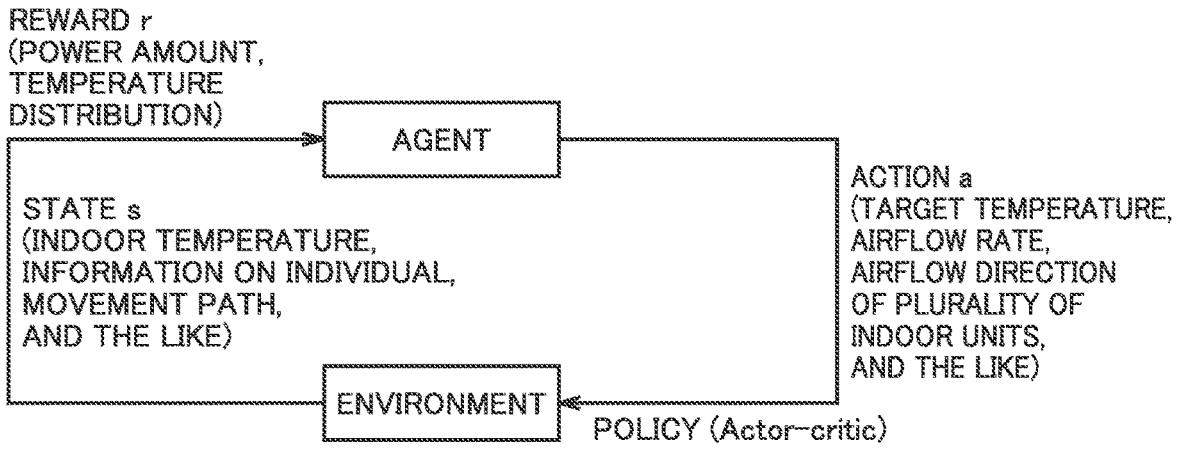
FIG. 9 is a diagram illustrating a structure of machine learning used by the control learning unit 103 according to a second embodiment.

FIG. 9 is a diagram illustrating a structure of machine learning used by control learning unit 103 according to a second embodiment. When the reinforcement learning model (control learning unit 103) illustrated in FIG. 7 is changed as illustrated in FIG. 9, the reinforcement learning model is also applicable to space recommendation control.

First, under the space recommendation control, temperature distribution in a space is controlled in accordance with a proportion of people belonging to the comfort clusters illustrated in FIGS. 5 and 6.

Specifically, under the space recommendation control, temperature distribution in the entire air conditioning space is controlled in accordance with the proportion of people belonging to classes CA to CD.

Parameters applied to the reinforcement learning model illustrated in FIG. 9 are as follows.

- state s: indoor temperature, indoor humidity, outside-air temperature, information on an individual in air conditioning area, radiation temperature distribution in a space, and movement path (movement time, movement distance, and movement speed).
- action a: change in target temperature, change in target humidity, and airflow rate of a plurality of indoor units.
- reward r: power amount, and radiation temperature distribution in a space.
- policy $\pi$: Actor-critic Actor-critic is a representative method for a reinforcement learning policy, and is a method of performing the policy basically as learned, but advancing learning by performing unlearned control with a certain probability.

As illustrated in FIG. 9, the temperature distribution is brought closer to temperature distribution based on the proportion of people by adding the current radiation temperature distribution to state s to change the reward to the radiation temperature distribution in the space.

Then, after the temperature distribution is controlled, a space that falls within the comfort range of each user is displayed on display unit 201 or the like of personal terminal 200, thereby recommending a comfortable air conditioning area to the possessor of personal terminal 200. As described above, it is possible to prompt the possessor of the personal terminal to move by indicating which space is comfortable to the possessor of the personal terminal.

Furthermore, adding information such as a future temperature change prediction (computation of a comfort change when the current indoor temperature is $\pm\alpha°$ C.) to state s allows space recommendation to be made in advance. Further, even when there is no future temperature prediction information, a similar function can be realized by clearly indicating a future temperature change such as displaying "it is recommended to move to area 1 when feeling hot, and move to area 2 when feeling cold." on the display unit.

Further, although the recommendation is made in accordance with a change in environment or a change in feeling as described above, it is also possible to analyze a movement history of personal terminal 200 and make a space recommendation on the basis of the action of a person, such as area 2 after exercise or area 3 when the action time is short.

(Summary)

The present disclosure relates to air conditioning management device 100 that is an information processing device capable of communicating with the plurality of personal terminals 200 possessed by a plurality of different possessors. Each of the plurality of personal terminals 200 is configured to acquire first data indicating a result of inputting whether a corresponding one of the possessors is comfortable, second data indicating a terminal location, and third data indicating a temperature and humidity at the terminal location. Air conditioning management device 100 includes personal comfort data learning unit 102 (first learning unit), air conditioning data holding unit 104, and air conditioning control device 110. Personal comfort data learning unit 102 (first learning unit) classifies the plurality of personal terminals 200 into the plurality of classes CA to CD illustrated in FIGS. 5 and 6 based on the first to third data transmitted from the plurality of personal terminals 200. Air conditioning data holding unit 104 is a storage unit that stores a plurality of control details each associated with a corresponding one of the plurality of classes into which personal comfort data learning unit 102 (first learning unit) classifies the plurality of personal terminals 200. Air conditioning control device 110 is a control unit that reads, from the storage unit, a control detail associated with a class into which personal terminal 200 detected in an air conditioning target space is classified among the plurality of classes and controls an air conditioning device.

Controlling the air conditioning device as described above achieves air conditioning suitable for an individual who possesses the terminal.

Further, the plurality of terminals are classified into the classes, and the settings of the air conditioner associated with the class to which the detected terminal belongs are used, so that it is not necessary to prepare settings for each individual who possesses the terminal, and the control of the air conditioner becomes simple accordingly.

Preferably, personal comfort data learning unit 102 (first learning unit) classifies the plurality of personal terminals 200 on the basis of the index PMV indicating comfort computed from the first to third data. As illustrated in FIGS. 5 and 6, the comfort range of the index PMV indicating that the possessor is comfortable is defined for each of the plurality of classes CA to CD. When the plurality of personal terminals 200 each belonging to a corresponding one of the plurality of classes are detected in the target space, air conditioning control device 110 controls air conditioning device 30 to cause the index when the target space is air-conditioned to fall within a range common to the plurality of comfort ranges each associated with a corresponding one of the plurality of classes.

Preferably, the plurality of personal terminals 200 are each structured to store the movement history of the possessor. The movement history is transmitted from personal terminal 200 located in the target space to air conditioning management device 100. Air conditioning control device 110 changes the control detail of air conditioning device 30 in accordance with the movement history thus received.

At the beginning, default air conditioning control settings suitable immediately after movement are used, and dissatisfaction as a result of changing the settings is learned.

Therefore, with the default changed and optimized, when the possessor returns from an outing in the summer, for example, control of causing the possessor to feel comfortable immediately after movement such as automatic setting to strong cooling is performed.

Preferably, air conditioning management device 100 further includes control learning unit 103 (second learning unit) that performs reinforcement learning of control of air conditioning device 30. Control learning unit 103 (second learning unit) is capable of changing the probability of selecting the enhancement of energy saving for reducing the power consumption of air conditioning device 30 and the probability of selecting the enhancement of comfort for increasing the comfort of the possessor of personal terminal 200 as the policy under reinforcement learning.

In the related art, a user sets a temperature to suit his/her preference, and then control is performed, which is inefficient air conditioning in terms of space, but it is possible to configure control to maximize energy saving in terms of space, and it is thus possible to reduce energy consumption.

Preferably, air conditioning control device 110 controls air conditioning device 30 so as to make temperature distribution different among a plurality of air conditioning areas, and causes personal terminal 200 to display an air conditioning area that is comfortable for a possessor of personal terminal 200 present in the target space.

Another aspect of the present embodiment discloses an air conditioning system including an air conditioning device and any one of the above-described information processing devices.

It should be understood that the embodiments disclosed herein are illustrative in all respects and not restrictive. The scope of the present disclosure is defined by the claims rather than the above description, and the present disclosure is intended to include the claims, equivalents of the claims, and all modifications within the scope.

The invention claimed is:

1. An information processing device to communicate with a plurality of personal terminals possessed by a plurality of different possessors, each of the plurality of personal terminals being configured to acquire first data indicating a result of inputting whether a corresponding one of the possessors is comfortable, second data indicating a terminal location, and third data indicating a temperature at the terminal location, the information processing device comprising:

a first learning unit to classify the plurality of personal terminals into a plurality of classes based on the first to third data transmitted from the plurality of personal terminals;

a storage unit to store a plurality of control details each associated with a corresponding one of the plurality of classes into which the first learning unit classifies the plurality of personal terminals; and a control unit to read, from the storage unit, a control detail associated with a class into which a personal terminal detected in an air conditioning target space is classified among the plurality of classes and control an air conditioning device, wherein the first learning unit classifies the plurality of personal terminals based on an index indicating comfort computed from the first to third data, for each of the plurality of classes, a comfort range of the index indicating that the possessors are comfortable is defined, and when the plurality of personal terminals each belonging to a corresponding one of the plurality of classes are detected in the target space, the control unit controls the air conditioning device to cause, when the target space is air-conditioned, the index to fall within a range common to the plurality of comfort ranges each associated with a corresponding one of the plurality of cases.

2. The information processing device according to claim 1, wherein each of the plurality of personal terminals is to store a movement history of a corresponding one of the possessors, the movement history is transmitted from a personal terminal present in the target space to the information processing device, and the control unit changes a control detail of the air conditioning device in accordance with the movement history received.

3. The information processing device according to claim 1, further comprising a second learning unit to perform reinforcement learning of control of the air conditioning device, wherein the second learning unit changes, as a policy of the reinforcement learning, a probability of selecting enhancement of energy saving for reducing power consumption of the air conditioning device and a probability of selecting enhancement of comfort for increasing comfort of the possessors of the personal terminals.

4. The information processing device according to claim 1, wherein the control unit controls the air conditioning device to make temperature distribution different among a plurality of air conditioning areas and causes a personal terminal present in the target space to display an air conditioning area suitable for comfort of a possessor of the personal terminal.

5. An air conditioning system comprising:

the information processing device according to claim 1; and the air conditioning device.

6. An air conditioning system comprising:

the information processing device according to claim 2; and the air conditioning device.

7. An air conditioning system comprising:

the information processing device according to claim 3; and the air conditioning device.

8. An air conditioning system comprising:

the information processing device according to claim 4; and the air conditioning device.

* * * * *